US007490615B2

(12) United States Patent
Rizzuto

(10) Patent No.: US 7,490,615 B2
(45) Date of Patent: Feb. 17, 2009

(54) HAIR STRAIGHTENING AND STYLING DEVICE

(75) Inventor: Leandro Rizzuto, Greenwich, CT (US)

(73) Assignee: Conair Corporation, Stamford, CT (US)

( * ) Notice: Subject to any disclaimer, the term of this patent is extended or adjusted under 35 U.S.C. 154(b) by 0 days.

(21) Appl. No.: 10/490,619

(22) PCT Filed: Sep. 25, 2001

(86) PCT No.: PCT/BE01/00167

§ 371 (c)(1),
(2), (4) Date: Aug. 3, 2004

(87) PCT Pub. No.: WO03/026457

PCT Pub. Date: Apr. 3, 2003

(65) Prior Publication Data

US 2004/0250831 A1 Dec. 16, 2004

(51) Int. Cl.
*A45D 24/06* (2006.01)

(52) U.S. Cl. ..... 132/129

(58) Field of Classification Search ..... 132/136, 132/118, 117, 142, 161, 228, 272, 150, 126, 132/131, 138, 152
See application file for complete search history.

(56) References Cited

U.S. PATENT DOCUMENTS 1,002,942 A * 9/1911 Taylor ..... 132/117
1,323,136 A * 11/1919 West ..... 132/118
1,362,460 A * 12/1920 Oscar ..... 132/136
1,572,399 A * 2/1926 Lewis ..... 132/136
1,606,734 A 10/1926 Lewis
1,858,851 A * 5/1932 Buchanan ..... 132/118
2,410,086 A 10/1946 Lewis ..... 132/14
2,513,897 A * 7/1950 Sonntag ..... 132/136
2,626,618 A * 1/1953 Collison ..... 132/136
3,192,934 A * 7/1965 Catania ..... 132/136
4,475,563 A * 10/1984 Martin ..... 132/136
5,449,007 A 9/1995 Arnhols ..... 132/136
5,553,632 A 9/1996 Burkhardt ..... 132/271
5,771,904 A * 6/1998 Lange et al. ..... 132/159
5,881,739 A * 3/1999 Walker et al. ..... 132/224

FOREIGN PATENT DOCUMENTS

DE 295 21 281 11/1996

* cited by examiner

*Primary Examiner*—Robyn Doan
*Assistant Examiner*—Rachel A Running
(74) *Attorney, Agent, or Firm*—Lawrence Cruz

(57) ABSTRACT

A brush for styling hair has a handle connected to a head with the head having a longitudinal axis and a number of stationary teeth and a number of movable teeth. The stationary teeth and the movable teeth both are arranged in a number of rows. The stationary teeth and the movable teeth are aligned with one another in a first position. The movable teeth traverse an amount in a direction substantially parallel to the longitudinal axis to a second position. The movable teeth in the second position are misaligned relative to the stationary teeth. The stationary teeth and the movable teeth tension hair disposed therethrough.

2 Claims, 4 Drawing Sheets

HAIR STRAIGHTENING AND STYLING DEVICE

BACKGROUND OF THE INVENTION

1. Field of the invention

The present invention aims to provide a device for straightening or flattening the hair, i.e. for styling the hair in order to make it smooth.

More specifically, the present invention aims to provide a device for straightening and styling the hair that is simple to use and cost-effective compared with the appliances currently available on the market.

An additional aim of the present invention is to provide a device which, when used, nevertheless treats the hair and the scalp with great care and which does not have the drawbacks of the prior art.

2. Description of the Related Art

Various devices suitable for smoothing down frizzy or curly hair are known. Generally, these appliances are based on the principle that the hair passes between tongs or rollers. Thus, document DE 2 615 267-A describes electrically-heated tongs in which the hair is placed between heating pads.

Document WO 98/35578 also describes tongs comprising two heating plates.

As an illustration of such device based on the use of rollers pinched together between which the hair is smoothed down, mention may be made of document U.S. Pat. No. 2,910,988-A as well as of document FR 2 571 944-A.

To assist the operation, most of these devices are provided with heating means such as electric resistors heating a pad or alternatively producing hot air or steam.

Large-toothed combs are also known, these are appliances provided with one or several combs making, generally under the effect of an engine, small, continuous and generally longitudinal jerky movements which are meant to untangle the hair when the appliance is passed through it. Appliances of this type are illustrated by documents WO 96/28990; U.S. Pat. No. 4,139,014; U.S. Pat. No. 3,897,794; U.S. Pat. No. 3,840,030; U.S. Pat. No. 3,272,023 and EP 0 687 426-A, but are not suitable for straightening or flattening the hair.

It is generally noticed that most of these existing devices do not entirely satisfy the users' wishes.

SUMMARY OF THE INVENTION

The Applicant noted that improved results can be obtained when, by applying heat into contact with a heating pad, optionally combined with hot air and/or steam, the hair is held in a taut position during the straightening or flattening operation.

According to the invention, the disclosed appliance can be connected to the electric supply and comprises a handle and a head, it is characterised in that the head is provided with an electrically-heated smoothing pad and also with a pinching element provided with a control that can be operated by the user and taking the form of at least three combs, the teeth of which can be brought, by means of the control, from an aligned tooth-to-tooth position in the same plane for each comb, towards a slightly out-of-line position of each row of comb teeth relative to the row of teeth of the neighbouring comb, so that locks of hair can be pinched.

The user will use the device by treating the hair from the root to the end, placing locks of hair between the teeth in the above-mentioned aligned tooth-to-tooth position of each comb.

Then, by operating a control with the thumb for example, he will gradually bring the rows of teeth of each comb out of line relative to the neighbouring row so that the locks of hair can be pinched and held taut.

In this position and without excessive tautness, he can then continue with a "combing" movement, smoothing down the hair in contact with the heating pad.

In practice, a row of teeth fastened to a mobile base, forming an intercalating comb that can perform a slight to-and-fro motion in the longitudinal direction by means of a manual control by the user, is provided on the head between two rows of fixed teeth, forming two parallel combs.

Preferably, this manual control takes the form of a push-button, which gradually moves the row of mobile teeth of the intercalating comb relative to the neighbouring rows of fixed teeth by a suitable mechanism.

When the pressure on the push-button is released, a spring brings back the row of teeth of the intercalating comb to its initial position.

Incidentally, the pad may be provided with holes allowing the circulation of hot air or steam by means of the electric supply, which reinforces the desired smoothing effect on the hair.

Other details and characteristics of the invention will emerge from the following description. This description is given by way of mere illustration and is non-restrictive.

DESCRIPTION OF ONE PREFERRED EMBODIMENT OF THE INVENTION

Figures 1, 2:
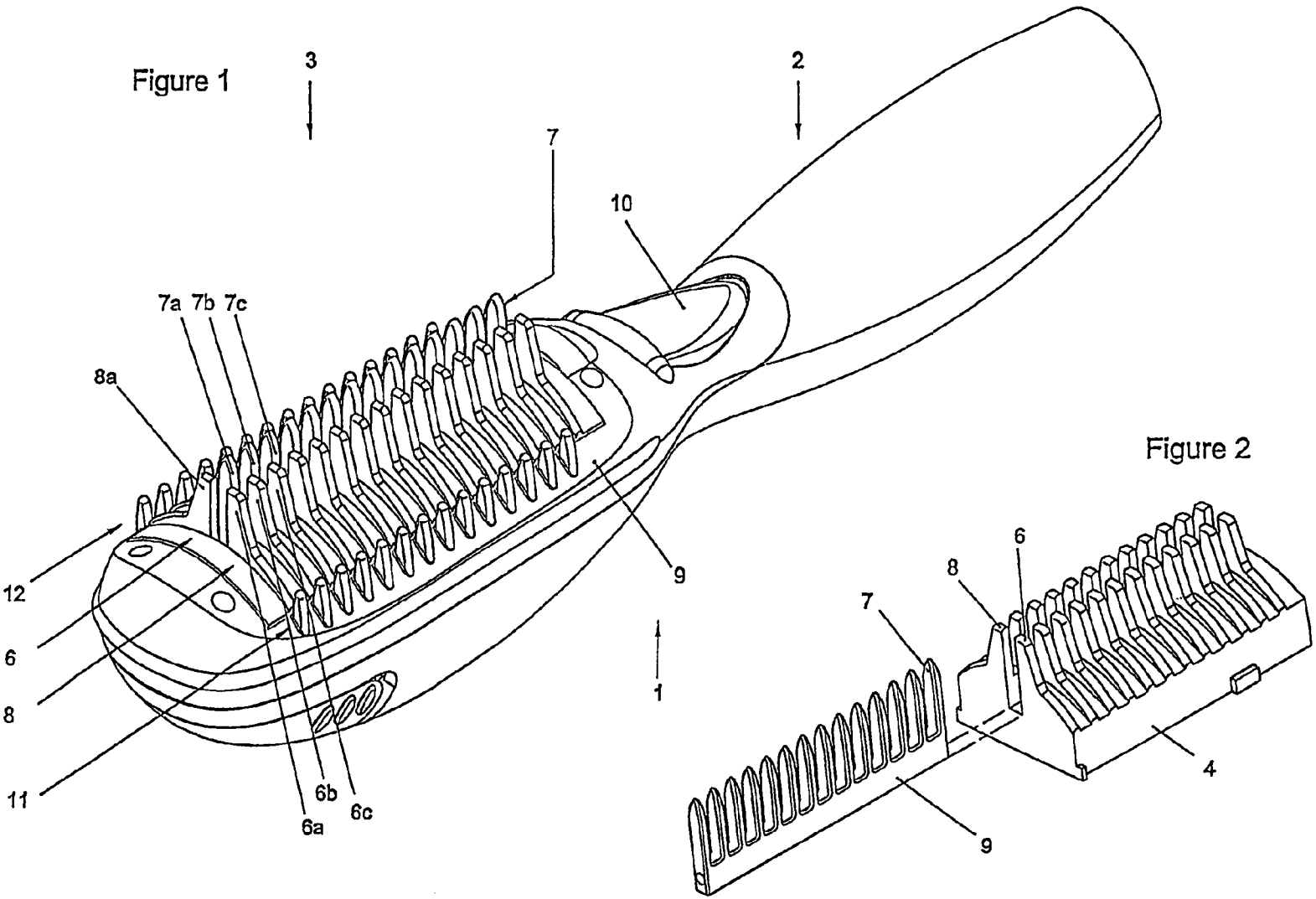
FIG. 1 is a general perspective view of the appliance according to the present invention.
FIG. 2 is a partial exploded view of the head of the appliance according to the present invention.

In one preferred embodiment as illustrated in FIG. 1, the device 1 essentially comprises a sleeve or a handle 2 and a head 3 as well as connection means to the electric supply.

The head 3 of said device 1 comprises heating means in the form of an electrically-heated smoothing pad 4 and a pinching element.

The pinching element herein comprises three essentially parallel combs 6, 7, 8, the comb 7 being located between the combs 6 and 8, as shown in FIG. 2. Each of these combs 6, 7, 8 comprises teeth, 6*a*, 6*b*, 6*c*, . . . , 7*a*, 7*b*, 7*c*, . . . , and 8*a*, 8*b*, 8*c*, . . . respectively.

The combs 6 and 8 are fixed, the teeth 6*a* and 8*a*, etc. respectively, are arranged on either side of the axle E of the device, in a relatively symmetrical position relative to this axle E and define together a series of successive parallel planes transversely oriented relative to the axle E of the appliance 1.

The intercalating comb 7 comprises teeth fastened to a mobile base 9. These teeth are longer than those of the fixed combs 6 and 8 so as to avoid damaging the scalp during the smoothing operation.

Figure 3B:
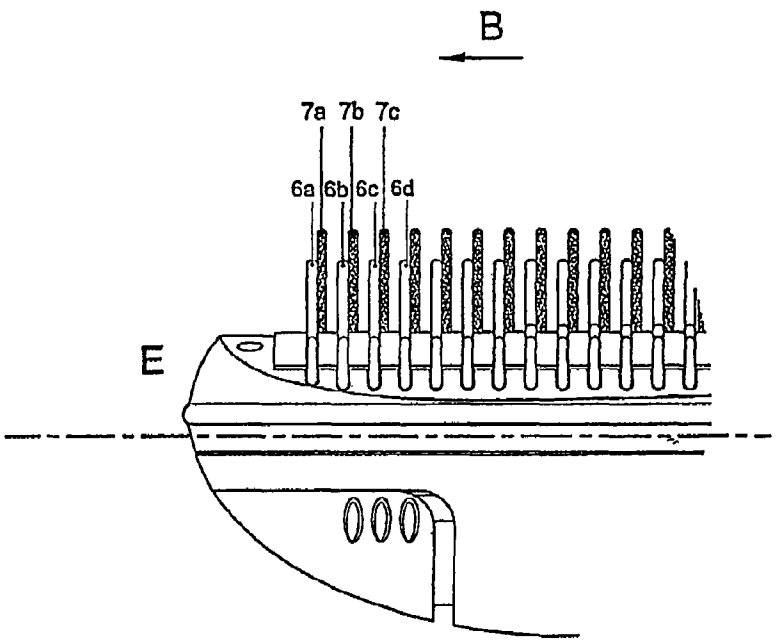
FIG. 3*b* is a view of the appliance according to the present invention, with the intercalating comb in the working position.
Figure 3A:
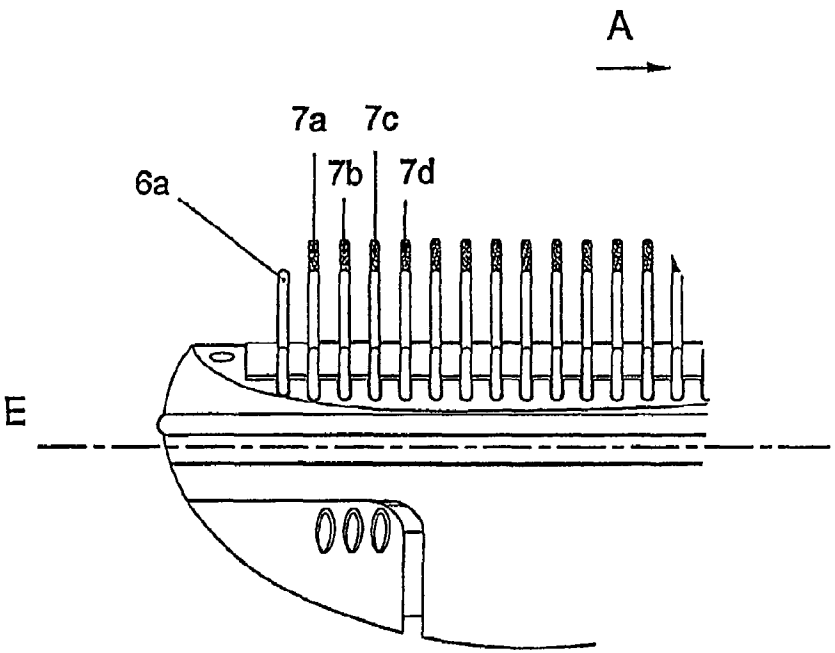
FIG. 3*a* is the appliance according to the present invention, with the intercalating comb in the standby position.

The mobile intercalating comb 7 can adopt two extreme positions relative to the fixed combs 6 and 8, respectively shown in FIGS. 3*a* and 3*b*.

Figure 4A:
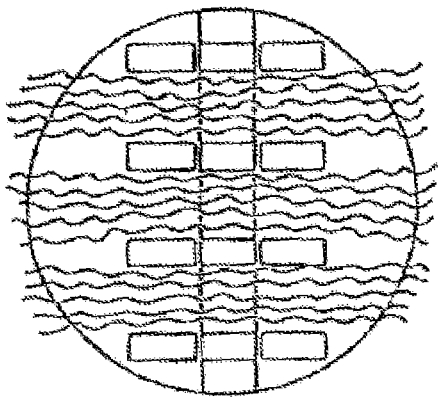
FIGS. 4*a*, 4*b* and 4*c* correspond to a scheme illustrating the principle for operating and using the device according to the present invention, with illustrated locks of hair.

In the "standby" position as illustrated in FIGS. 3*a* and 4*a*, the teeth 7*a*, 7*b*, 7*c*, . . . of the intercalating comb 7 are in the same plane as the teeth of the combs 6 and 8, so that the teeth 7*a*, 7*b*, 7*c*, . . . are essentially aligned with the teeth 6*a*, 8*a*; 6*b*, 8*b*; 6*c*, 7*c*; . . . , respectively.

Figure 4B:
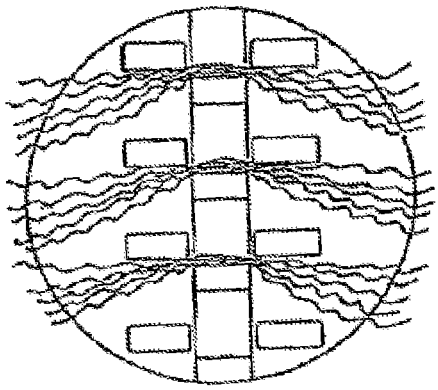
Figure 4C:
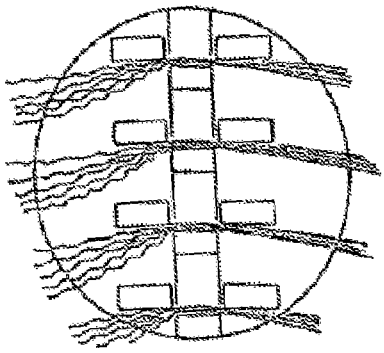

In the "working" position as illustrated in FIGS. 3*b*, 4*b* and 4*c*, the teeth 7*a*, 7*b*, 7*c*, . . . of the intercalating comb 7 are out of the above-mentioned plane, so that the teeth 7*a*, 7*b* are no longer aligned with the teeth 6*a*, 8*a*; 6*b*, 8*b*; 6*c*, 7*c*; . . . respectively, but are out of line relative to the latter along the direction defined by the axle E of the appliance 1.

Moreover, the appliance 1 comprises control means 10 that may be operated by the user and that are intended to move the row of teeth 7*a*, 7*b*, 7*c*, constituting the intercalating comb 7 between the two extreme positions of FIGS. 3*a* and 3*b* by a sliding motion in the longitudinal direction following the arrows A and B as illustrated in FIGS. 3*a* and 3*b*.

Said control means 10 herein take the form of a push-button on the sleeve 2. According to one preferred embodiment of the invention, the standby position of the teeth of the intercalating comb 7 is obtained when the push-button 10 is released. The extreme working position of the teeth of the intercalating comb 7 is obtained when the push-button 10 is totally pressed. All intermediate positions are possible.

In concrete terms, when the user wishes to straighten or flatten hair, he proceeds in the following manner.

First, he places the appliance as close as possible to the crown of the head and takes up the base of the locks of hair by means of the combs 6, 7, 8, the teeth 7*a*, 7*b*, 7*c*, . . . being in the standby position as illustrated in FIG. 4*a*.

Then, the user presses the push-button 10 so as to control the sliding of the intercalating comb 7 relative to the fixed combs 6 and 8 as far as the extreme working position and thus to pinch the base of the locks of hair as illustrated in FIG. 4*b*.

The user gradually applies pressure to the push-button in order to tauten the hair and gradually slides the head 3 provided with the heating pad 4 in a continuous motion along the locks of hair, said locks of hair are thus subjected to the action of the heat when sliding over the heating pads 4, while at the same time being subjected to tensile forces via the combs 6, 7 and 8 as illustrated in FIG. 4*c*.

Once these locks have been smoothed down over their entire length, the user controls the return of the intercalating comb 7 to its standby position by releasing the push-button 10, releases said locks of hair and repeats the same operations for other locks of hair, until the entire head of hair has been straightened.

The tension exerted by the pinching element facilitates the straightening operation by optimising the sliding of the locks of hair on the heating pad 4.

Two rows of smaller teeth 11 and 12 are placed on either side of the combs 6, 7 and 8, intended to straighten the hair. These teeth are intended to prevent the heating pads from coming into contact with the scalp. The flanking arrangement of the rows of small teeth 11 and 12 relative to the combs 6, 7 and 8 allows the device to be used with either the left hand or the right hand.

Figure 5:
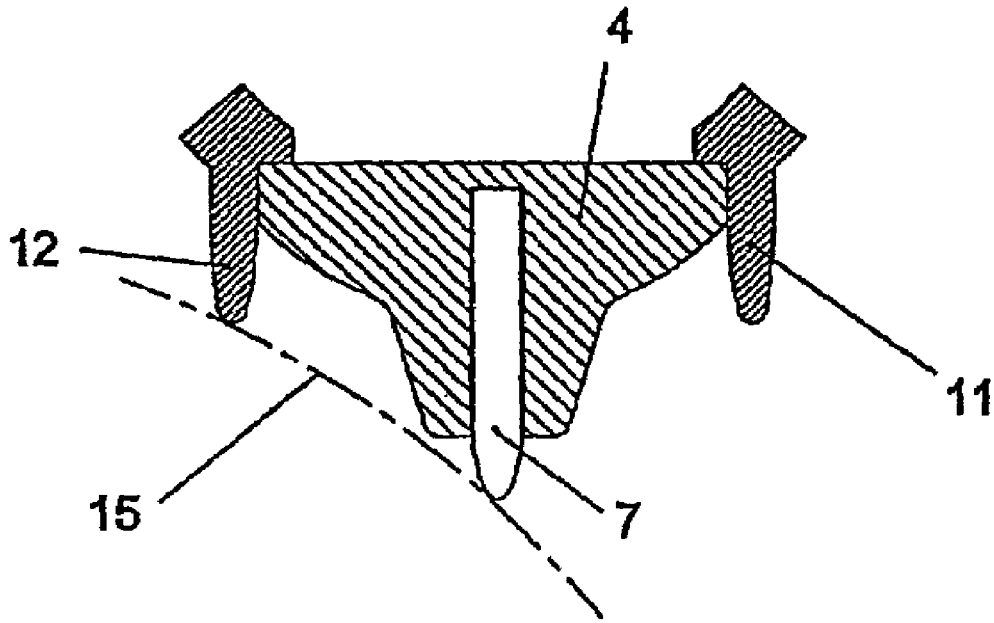
FIG. 5 is a cross-section view of the position of the device relative to the skull.

The position of the rows of teeth 11 and 12 relative to the combs 6, 7 and 8 facing the curve of the skull 15 is illustrated in FIG. 5.

What is clamed is:

1. A device for styling hair, said device comprising a handle defining a longitudinal axis;

a head extending longitudinally from said handle;

a stationary comb fixed to said head and having two rows of stationary comb teeth, said rows each extending longitudinally, and each of said stationary comb teeth being of a first height;

a moveable comb mounted for movement longitudinally with respect to said stationary comb and having a row of movable comb teeth of a second height that is at least as great as said first height, said movable comb teeth being aligned parallel to and adjacent to said stationary comb teeth;

a first row of side comb teeth, said first row being fixed to said head parallel to and spaced apart at a first normal distance from said stationary comb adjacent to a first side of said head, wherein each and every tooth of said first row of side comb teeth has a height that is less than said first height; and a second row of side comb teeth, said second row being fixed to said head parallel to and spaced apart at a second normal distance from said stationary comb adjacent to a second side of said head, wherein each and every tooth of said second row of side comb teeth has a height that is less than said first height wherein the first normal distance is greater than a normal distance between the movable comb and one of the two rows of stationary comb teeth.

2. The device according to claim 1, wherein each of said stationary comb teeth has a width that varies along its length and that is greater than its thickness, wherein said width is wider at a base of said stationary comb teeth and tapers narrower on one side of said each of stationary comb teeth to a distal tip of said stationary comb teeth, wherein another side that is opposite the one side of said each of stationary comb teeth that tapers narrower to the distal tip is vertical to the head and wherein a cross section of said distal tip is a quadrangle.

* * * * *